US012320568B2

(12) United States Patent
Yamaguchi et al.

(10) Patent No.: US 12,320,568 B2
(45) Date of Patent: Jun. 3, 2025

(54) COMPRESSOR UNIT AND REFRIGERATION APPARATUS

(71) Applicants: DAIKIN INDUSTRIES, LTD., Osaka (JP); DAIKIN EUROPE N.V., Ostend (BE)

(72) Inventors: Takahiro Yamaguchi, Ostend (BE); Yousuke Matsuda, Dubai (AE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 279 days.

(21) Appl. No.: 17/685,622

(22) Filed: Mar. 3, 2022

(65) Prior Publication Data

US 2022/0186989 A1 Jun. 16, 2022

Related U.S. Application Data

(63) Continuation of application No. PCT/JP2019/034786, filed on Sep. 4, 2019.

(51) Int. Cl.
*F25B 7/00* (2006.01)
*F24F 11/36* (2018.01)
(Continued)

(52) U.S. Cl.
CPC ..... *F25B 7/00* (2013.01); *F24F 11/36* (2018.01); *F24F 13/20* (2013.01); *F25B 40/00* (2013.01);
(Continued)

(58) Field of Classification Search
CPC ..... F24F 11/36; F24F 1/24; F25B 7/00; F25B 2500/222
See application file for complete search history.

(56) References Cited

U.S. PATENT DOCUMENTS 373,319 A * 11/1887 Snyder ..... F25B 7/00 62/335
5,784,893 A * 7/1998 Furuhama ..... F25D 17/02 62/434
(Continued)

FOREIGN PATENT DOCUMENTS

DE 10 2016 112 851 A1 1/2018
FR 2 825 789 A1 12/2002
(Continued)

OTHER PUBLICATIONS

International Search Report (PCT/ISA/210) issued in PCT/JP2019/034786 mailed on Oct. 29, 2019.
(Continued)

*Primary Examiner* — Christopher R Zerphey
(74) *Attorney, Agent, or Firm* — Birch, Stewart, Kolasch & Birch, LLP

(57) ABSTRACT

A compressor unit includes a first case, a first compressor, a cascade heat exchanger, a second compressor, a first connecting port, and a second connecting port. The first compressor, the cascade heat exchanger, and a heat source heat exchanger accommodated in a second case constitute a first refrigerant cycle. The second compressor, the cascade heat exchanger, and a utilization heat exchanger accommodated in a third case constitute a second refrigerant cycle. The first connecting port is connected to the heat source heat exchanger via a first connection piping. The second connecting port is connected to the utilization heat exchanger via a second connection piping.

12 Claims, 9 Drawing Sheets

(51) Int. Cl.

| | |
|---|---|
| ***F24F 13/20*** | (2006.01) |
| ***F25B 40/00*** | (2006.01) |
| ***F25B 40/02*** | (2006.01) |
| ***F25B 40/06*** | (2006.01) |
| ***F25B 49/00*** | (2006.01) |
| ***F25B 49/02*** | (2006.01) |

(52) U.S. Cl.

CPC ..... *F25B 49/005* (2013.01); *F25B 49/02* (2013.01); *F25B 40/02* (2013.01); *F25B 40/06* (2013.01); *F25B 2400/054* (2013.01); *F25B 2400/13* (2013.01); *F25B 2500/222* (2013.01)

(56) References Cited

U.S. PATENT DOCUMENTS

| | | | | |
|---|---|---|---|---|
| 8,464,548 | B2 * | 6/2013 | Okuda | F24F 1/22 62/259.2 |
| 9,212,825 | B2 * | 12/2015 | Wakamoto | F25B 13/00 |
| 9,459,013 | B2 * | 10/2016 | Yamashita | F25B 13/00 |
| 9,482,443 | B1 * | 11/2016 | Backman | F24F 13/20 |
| 10,866,004 | B2 * | 12/2020 | Shiohama | F25B 49/005 |
| 11,131,471 | B1 * | 9/2021 | Butler | F24F 11/84 |
| 11,293,670 | B2 * | 4/2022 | Matsuoka | F25B 29/003 |
| 11,609,031 | B2 * | 3/2023 | Matsuda | F25B 41/24 |
| 2003/0041607 | A1 | 3/2003 | Baumert et al. | |
| 2004/0031280 | A1 * | 2/2004 | Martin | F25B 25/005 62/434 |
| 2014/0260361 | A1 * | 9/2014 | Rodier | F25D 21/12 62/340 |
| 2016/0356534 | A1 * | 12/2016 | Hatada | F25B 13/00 |
| 2018/0128505 | A1 * | 5/2018 | Baetens | F24F 1/26 |
| 2018/0209669 | A1 | 7/2018 | Baetens et al. | |
| 2019/0170599 | A1 * | 6/2019 | Kester | G01M 3/16 |
| 2019/0234659 | A1 | 8/2019 | Erfurth et al. | |
| 2019/0338971 | A1 | 11/2019 | Yoneyama et al. | |
| 2022/0003443 | A1 * | 1/2022 | Kobayashi | F24F 5/00 |
| 2022/0268499 | A1 * | 8/2022 | Yamaguchi | F25B 41/24 |
| 2023/0020042 | A1 * | 1/2023 | Ohno | F25B 7/00 |

FOREIGN PATENT DOCUMENTS

| | | | |
|---|---|---|---|
| JP | 62-26458 | A | 2/1987 |
| JP | 7-159010 | A | 6/1995 |
| JP | 2011-75117 | A | 4/2011 |
| JP | 2012-112622 | A | 6/2012 |
| JP | 2015-38390 | A | 2/2015 |
| JP | 2018-511771 | A | 4/2018 |
| JP | 2018-84410 | A | 5/2018 |
| WO | WO 2015/114783 | A1 | 8/2015 |
| WO | WO 2016/166988 | A1 | 10/2016 |
| WO | WO 2018/147412 | A1 | 8/2018 |
| WO | WO 2019/058464 | A1 | 3/2019 |
| WO | WO 2019/097820 | A1 | 5/2019 |

OTHER PUBLICATIONS

Written Opinion (PCT/ISA/237) issued in PCT/JP2019/034786 mailed on Oct. 29, 2019.

English translation of International Preliminary Report on Patentability and Written Opinion of the International Searching Authority for International Application No. PCT/JP2019/034786, dated Mar. 17, 2022.

Extended European Search Report for European Application No. 19944360.7, dated Aug. 9, 2022.

* cited by examiner

COMPRESSOR UNIT AND REFRIGERATION APPARATUS

CROSS REFERENCE TO RELATED APPLICATIONS

This application is a Continuation of PCT International Application No. PCT/JP2019/034786, filed on Sep. 4, 2019, which is hereby expressly incorporated by reference into the present application.

TECHNICAL FIELD

The present disclosure relates to a compressor unit and a refrigeration apparatus including the compressor unit.

BACKGROUND ART

Patent Literature 1 (Japanese Patent Application Laid-Open Publication No. 2018-511771) discloses an air conditioner including a compressor unit, a heat source heat exchanger unit, and a utilization unit.

SUMMARY

A compressor unit according to one aspect includes a first case, a first compressor accommodated in the first case, a cascade heat exchanger accommodated in the first case, a second compressor accommodated in the first case, a first connecting port, and a second connecting port. The first compressor, the cascade heat exchanger, and a heat source heat exchanger accommodated in a second case provided separately from the first case constitute a first refrigerant cycle. The first refrigerant cycle adopts the heat source heat exchanger as a heat source and causes circulation of a first refrigerant. The second compressor, the cascade heat exchanger, and a utilization heat exchanger accommodated in a third case provided separately from the first case constitute a second refrigerant cycle. The second refrigerant cycle adopts the cascade heat exchanger as a heat source and causes circulation of a second refrigerant. The cascade heat exchanger executes heat exchange between the first refrigerant and the second refrigerant. The first connecting port is connected to the heat source heat exchanger via a first connection pipe. The second connecting port is connected to the utilization heat exchanger via a second connection pipe.

This configuration divides a refrigerant circuit constituted by the compressor unit into the first refrigerant cycle and the second refrigerant cycle. Both the first refrigerant and the second refrigerant are thus less likely to leak in a case where the refrigerant circuit has damage or the like, achieving reduction in volume of a leaking refrigerant.

DESCRIPTION OF EMBODIMENTS

First Embodiment

(1) Overall Configuration

Figure 1:
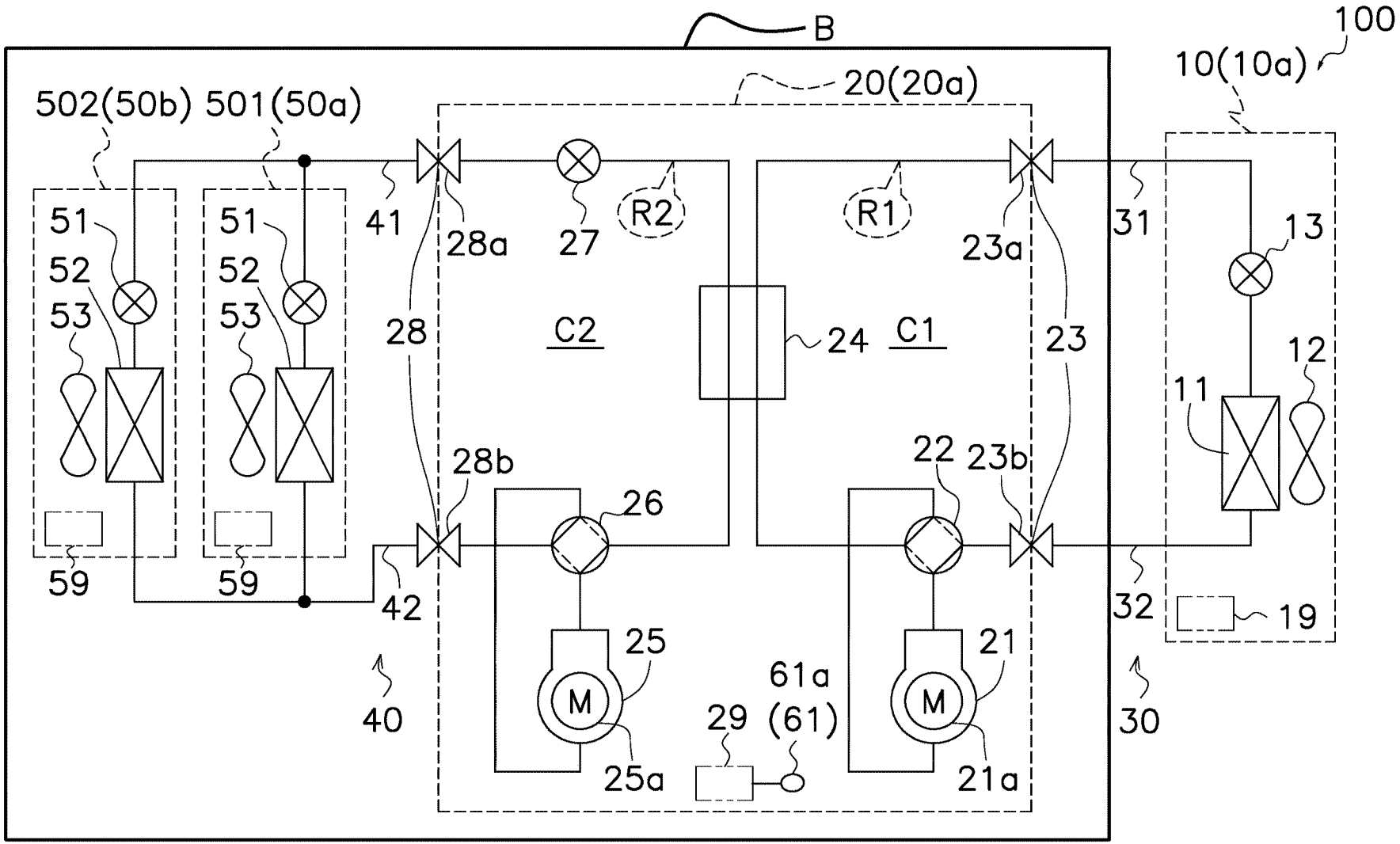
FIG. 1 is a circuit diagram of a refrigeration apparatus 100 according to a first embodiment.

FIG. 1 is a circuit diagram of a refrigeration apparatus 100 according to the first embodiment. The refrigeration apparatus 100 is typically exemplified by an air conditioner, but is not limited thereto. For example, the refrigeration apparatus 100 may be a refrigerator, a freezer, and a hot water supplier. The refrigeration apparatus 100 includes a heat source heat exchanger unit 10, a compressor unit 20, a first connection piping 30, utilization units 501 and 502, and a second connection piping 40.

(2) Detailed Configurations

(2-1) Heat Source Heat Exchanger Unit 10

The heat source heat exchanger unit 10 is disposed outside a building B. The heat source heat exchanger unit 10 includes a case 10*a*, a heat source heat exchanger 11, a heat source fan 12, a heat source heat exchanger unit expansion valve 13, and a heat source heat exchanger unit control unit 19. The heat source heat exchanger unit 10 handles a first refrigerant R1.

(2-1-1) Case 10*a*

The case 10*a* accommodates components constituting the heat source heat exchanger unit 10. The case 10*a* is made of a metal or the like.

(2-1-2) Heat Source Heat Exchanger 11

The heat source heat exchanger 11 functions as a heat source. The heat source heat exchanger 11 exchanges heat between air outside the building B and the first refrigerant R1. During cooling operation, the heat source heat exchanger 11 functions as a heat radiator (or a condenser) for the first refrigerant R1. During heating operation, the heat source heat exchanger 11 functions as a heat absorber (or an evaporator) for the first refrigerant R1.

(2-1-3) Heat Source Fan 12

The heat source fan 12 generates an air flow to promote heat exchange at the heat source heat exchanger 11.

(2-1-4) Heat Source Heat Exchanger Unit Expansion Valve 13

The heat source heat exchanger unit expansion valve 13 decompresses the first refrigerant R1. The heat source heat exchanger unit expansion valve 13 is configured to adjust its opening degree.

(2-1-5) Heat Source Heat Exchanger Unit Control Unit 19

The heat source heat exchanger unit control unit 19 includes a microcomputer and a memory. The heat source heat exchanger unit control unit 19 controls the heat source fan 12, the heat source heat exchanger unit expansion valve 13, and the like. The memory stores software for control of these components.

The heat source heat exchanger unit control unit 19 transmits and receives data and a command, via a communication line (not depicted), to and from each of a compressor unit control unit 29 and a utilization unit control unit 59, which will be described later.

(2-2) Compressor Unit 20

Figure 2:
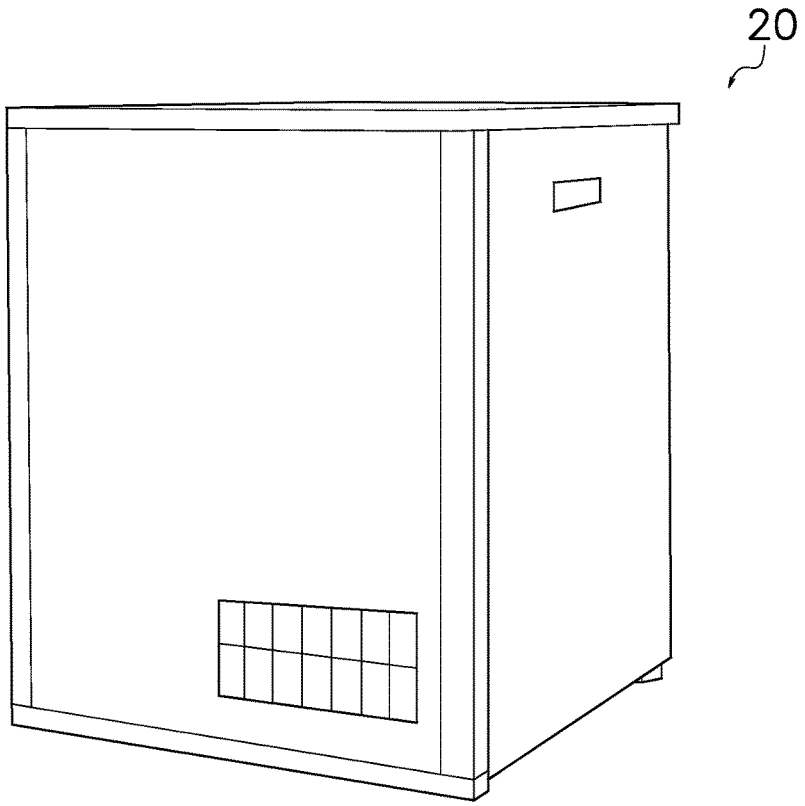
FIG. 2 is an external view of a compressor unit 20.

The compressor unit 20 has external appearance depicted in FIG. 2. As depicted in FIG. 1, the compressor unit 20 is disposed inside the building B. The compressor unit 20 includes a case 20*a*, a first compressor 21, a first four-way switching valve 22, a first connecting port 23, a cascade heat exchanger 24, a second compressor 25, a second four-way switching valve 26, a compressor unit expansion valve 27, a second connecting port 28, a leakage detection sensor 61, and the compressor unit control unit 29. The compressor unit 20 handles the first refrigerant R1 and a second refrigerant R2.

(2-2-1) Case 20*a*

The case 20*a* accommodates components constituting the compressor unit 20. The case 20*a* is made of a metal or the like.

(2-2-2) First Compressor 21

The first compressor 21 compresses the first refrigerant R1 that is sucked and is in a low-pressure gas state to obtain the first refrigerant R1 in a high-pressure gas state. The first compressor 21 includes a first compressor motor 21*a*. The first compressor motor 21*a* generates motive power necessary for compression.

The first compressor 21 is a vibration source and may thus cause refrigerant leakage from the first compressor 21 and a component adjacent thereto.

(2-2-3) First Four-Way Switching Valve 22

The first four-way switching valve 22 switches connection of a refrigerant circuit. During cooling operation, the first four-way switching valve 22 achieves connection depicted by solid lines in FIG. 1. During heating operation, the first four-way switching valve 22 achieves connection depicted by broken lines in FIG. 1.

(2-2-4) First Connecting Port 23

The first connecting port 23 includes a pair of ports provided for connection of the first connection piping 30 to be described later. The first connecting port 23 is provided with a first liquid side shutoff valve 23*a* and a first gas side shutoff valve 23*b*. The first liquid side shutoff valve 23*a* and the first gas side shutoff valve 23*b* shut off a refrigerant flow path in response to a received command.

(2-2-5) Cascade Heat Exchanger 24

The cascade heat exchanger 24 includes two refrigerant flow paths and exchanges heat between the first refrigerant R1 and the second refrigerant R2. During cooling operation, the cascade heat exchanger 24 functions as a heat absorber (or an evaporator) for the first refrigerant R1, and as a heat radiator (or a condenser) for the second refrigerant R2. During heating operation, the cascade heat exchanger 24 functions as a heat radiator (or a condenser) for the first refrigerant R1, and as a heat absorber (or an evaporator) for the second refrigerant R2.

(2-2-6) Second Compressor 25

The second compressor 25 compresses the second refrigerant R2 that is sucked and is in a low-pressure gas state to obtain the second refrigerant R2 in a high-pressure gas state. The second compressor 25 includes a second compressor motor 25*a*. The second compressor motor 25*a* generates motive power necessary for compression.

The second compressor 25 is a vibration source and may thus cause refrigerant leakage from the second compressor 25 and a component adjacent thereto.

(2-2-7) Second Four-Way Switching Valve 26

The second four-way switching valve 26 switches connection of the refrigerant circuit. During cooling operation, the second four-way switching valve 26 achieves the connection depicted by the solid lines in FIG. 1. During heating operation, the second four-way switching valve 26 achieves the connection depicted by the broken lines in FIG. 1.

(2-2-8) Compressor Unit Expansion Valve 27

The compressor unit expansion valve 27 decompresses the second refrigerant R2. The compressor unit expansion valve 27 is configured to adjust its opening degree.

(2-2-9) Second Connecting Port 28

The second connecting port 28 includes a pair of ports provided for connection of the second connection piping 40 to be described later. The second connecting port 28 is provided with a second liquid side shutoff valve 28*a* and a second gas side shutoff valve 28*b*. The second liquid side shutoff valve 28*a* and the second gas side shutoff valve 28*b* shut off the refrigerant flow path in response to a received command.

(2-2-10) Leakage Detection Sensor 61

The leakage detection sensor 61 detects refrigerant leakage. The leakage detection sensor 61 is a refrigerant detection sensor 61*a* configured to detect presence of at least one of the first refrigerant R1 or the second refrigerant R2.

(2-2-11) Compressor Unit Control Unit 29

The compressor unit control unit 29 includes a microcomputer and a memory. The compressor unit control unit 29 controls the first compressor motor 21*a*, the first four-way switching valve 22, the first liquid side shutoff valve 23*a*, the first gas side shutoff valve 23*b*, the second compressor motor 25*a*, the second four-way switching valve 26, the compressor unit expansion valve 27, the second liquid side shutoff valve 28*a*, the second gas side shutoff valve 28*b*, and the like. The compressor unit control unit 29 receives a signal from the leakage detection sensor 61. The memory stores software for control of these components.

The compressor unit control unit 29 transmits and receives data and a command, via a communication line (not depicted), to and from each of the heat source heat exchanger unit control unit 19 and the utilization unit control unit 59 to be described later.

(2-3) First Connection Piping 30

The first connection piping 30 connects the heat source heat exchanger unit 10 and the compressor unit 20. The first connection piping 30 includes a first liquid connection pipe 31 and a first gas connection pipe 32.

(2-3-1) First Liquid Connection Pipe 31

The first liquid connection pipe 31 connects the heat source heat exchanger unit 10 and the first liquid side shutoff valve 23*a*. The first liquid connection pipe 31 guides the first refrigerant R1 principally in a high-pressure liquid state or in a low-pressure gas-liquid two-phase state.

(2-3-2) First Gas Connection Pipe 32

The first gas connection pipe 32 connects the heat source heat exchanger unit 10 and the first gas side shutoff valve 23*b*. The first gas connection pipe 32 guides the first refrigerant R1 principally in the high-pressure gas state or in the low-pressure gas state.

(2-4) Utilization Units 501 and 502

Figure 3:
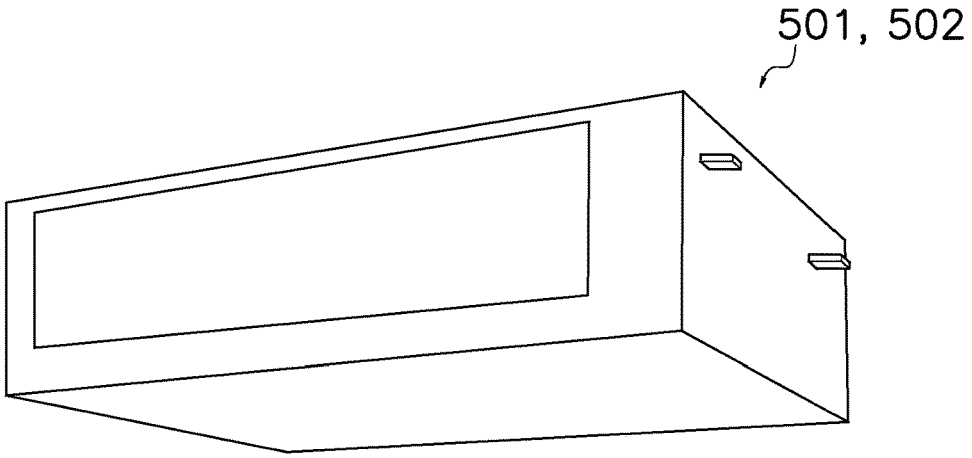
FIG. 3 is an external view of indoor units 501 and 502.

The utilization units 501 and 502 each have external appearance depicted in FIG. 3. As depicted in FIG. 1, the utilization units 501 and 502 are disposed inside the building B. The utilization units 501 and 502 handle the second refrigerant R2. The utilization unit 501 and the utilization unit 502 are configured identically to each other. The following description will thus be made to only the utilization unit 501 without repetitively describing the utilization unit 502. The utilization unit 501 includes a case 50*a*, a utilization unit expansion valve 51, a utilization heat exchanger 52, a utilization fan 53, and the utilization unit control unit 59.

(2-4-1) Case 50*a*

The case 50*a* accommodates components constituting the utilization unit 501.

(2-4-2) Utilization Unit Expansion Valve 51

The utilization unit expansion valve 51 decompresses the second refrigerant R2. The utilization unit expansion valve 51 limits a flow rate of the second refrigerant R2. The utilization unit expansion valve 51 is configured to adjust its opening degree.

(2-4-3) Utilization Heat Exchanger 52

The utilization heat exchanger 52 provides a user with low temperature heat or high temperature heat. The utilization heat exchanger 52 exchanges heat between air inside the building B and the second refrigerant R2. During cooling operation, the utilization heat exchanger 52 functions as a heat absorber (or an evaporator) for the second refrigerant R2. During heating operation, the utilization heat exchanger 52 functions as a heat radiator (or a condenser) for the second refrigerant R2.

(2-4-4) Utilization Fan 53

The utilization fan 53 generates an air flow to promote heat exchange at the utilization heat exchanger 52.

(2-4-5) Utilization Unit Control Unit 59

The utilization unit control unit 59 includes a microcomputer and a memory. The utilization unit control unit 59 controls the utilization unit expansion valve 51, the utilization fan 53, and the like. The memory stores software for control of these components.

The utilization unit control unit 59 transmits and receives data and a command, via a communication line (not depicted), to and from each of the heat source heat exchanger unit control unit 19 and the compressor unit control unit 29.

(2-5) Second Connection Piping 40

The second connection piping 40 connects the compressor unit 20 and the utilization units 501 and 502. The second connection piping 40 includes a second liquid connection pipe 41 and a second gas connection pipe 42.

(2-5-1) Second Liquid Connection Pipe 41

The second liquid connection pipe 41 connects the second liquid side shutoff valve 28*a* and the utilization units 501 and 502. The second liquid connection pipe 41 guides the second refrigerant R2 principally in a high-pressure liquid state or in a low-pressure gas-liquid two-phase state.

(2-5-2) Second Gas Connection Pipe 42

The second gas connection pipe 42 connects the second gas side shutoff valve 28*b* and the utilization units 501 and 502. The second gas connection pipe 42 guides the second refrigerant R2 principally in the high-pressure gas state or in the low-pressure gas state.

(3) Configuration of Refrigerant Circuit

The refrigeration apparatus 100 entirely constitutes two refrigerant cycles.

(3-1) First Refrigerant Cycle C1

The first refrigerant cycle C1 causes circulation of the first refrigerant R1. The first refrigerant cycle C1 adopts the heat source heat exchanger 11 as a heat source. The first refrigerant cycle C1 is constituted by components such as the first compressor 21, the first four-way switching valve 22, the first gas side shutoff valve 23*b*, the heat source heat exchanger 11, the heat source heat exchanger unit expansion valve 13, the first liquid side shutoff valve 23*a*, and the cascade heat exchanger 24.

(3-2) Second Refrigerant Cycle C2

The second refrigerant cycle C2 causes circulation of the second refrigerant R2. The second refrigerant cycle C2 adopts the cascade heat exchanger 24 as a heat source. The second refrigerant cycle C2 is constituted by components such as the second compressor 25, the second four-way switching valve 26, the cascade heat exchanger 24, the compressor unit expansion valve 27, the second liquid side shutoff valve 28*a*, the utilization unit expansion valve 51, the utilization heat exchanger 52, and the second gas side shutoff valve 28*b*.

(3-3) Refrigerants

The first refrigerant R1 is R32 or carbon dioxide. The first refrigerant R1 can thus be reduced in global warming potential (GWP) valve. This leads to inhibition of global warming due to use of the refrigeration apparatus 100.

The second refrigerant R2 is R32 or R410A. The second refrigerant R2 can thus be reduced in GWP valve. This leads to inhibition of global warming due to use of the refrigeration apparatus 100.

Exemplarily adopting R32 or carbon dioxide as the first refrigerant R1 and R32 as the second refrigerant R2 inhibits global warming caused by the refrigeration apparatus 100.

The first refrigerant R1 and the second refrigerant R2 are preferably natural refrigerants.

(4) Control Upon Leakage Detection

When the leakage detection sensor 61 detects refrigerant leakage, the compressor unit control unit 29 shuts off the first liquid side shutoff valve 23*a*, the first gas side shutoff valve 23*b*, the second liquid side shutoff valve 28*a*, and the second gas side shutoff valve 28*b*. This inhibits the first refrigerant R1 and the second refrigerant R2 in the compressor unit 20 from flowing out of the compressor unit 20.

(5) Characteristics (5-1)

The refrigerant circuit constituted by the compressor unit 20 is divided into the first refrigerant cycle C1 and the second refrigerant cycle C2. Both the first refrigerant R1 and the second refrigerant R2 are thus less likely to leak in a case where the refrigerant circuit has damage or the like, achieving reduction in volume of a leaking refrigerant.

The compressor unit 20 and the heat source heat exchanger unit 10 are constituted as separate units. The refrigeration apparatus 100 accordingly includes the first connection piping 30 connecting the compressor unit 20 and the heat source heat exchanger unit 10. The refrigeration apparatus 100 including the first connection piping 30 having a large length uses a more refrigerant in comparison to a refrigeration apparatus including a compressor and a heat source heat exchanger belonging to an identical unit. However, the refrigeration apparatus 100 thus configured has two refrigerant cycles including the first refrigerant cycle C1 and the second refrigerant cycle C2 to inhibit spread of a leaking refrigerant.

(5-2)

The compressor unit 20 includes the leakage detection sensor 61. This enables quick detection of refrigerant leakage in an exemplary case where a vibration source such as a compressor damages the refrigerant circuit.

The leakage detection sensor 61 is the refrigerant detection sensor 61*a*. This enables direct detection of refrigerant leakage.

(5-3)

The first refrigerant cycle C1 includes the first liquid side shutoff valve 23*a* and the first gas side shutoff valve 23*b*. The first liquid side shutoff valve 23*a* and the first gas side shutoff valve 23*b* are shut off upon detection of refrigerant leakage to inhibit a leaking refrigerant from reaching outside the compressor unit 20.

The second refrigerant cycle C2 includes the second liquid side shutoff valve 28*a* and the second gas side shutoff valve 28*b*. The second liquid side shutoff valve 28*a* and the second gas side shutoff valve 28*b* are shut off upon detection of refrigerant leakage to inhibit a leaking refrigerant from reaching outside the compressor unit 20.

(5-4)

Upon detection of refrigerant leakage, the compressor unit control unit 29 automatically closes the first liquid side shutoff valve 23*a* and the first gas side shutoff valve 23*b*. This enables quick shutoff of the refrigerant circuit.

This configuration can also confine the first refrigerant R1 within the first connection piping 30 and the heat source heat exchange unit 10.

(5-5)

During heating operation, a liquid refrigerant flows in each of the first liquid connection pipe 31 in the first refrigerant cycle C1 and the second liquid connection pipe 41 in the second refrigerant cycle C2. This reduces pressure loss of a refrigerant flow in each of the first liquid connection pipe 31 and the second liquid connection pipe 41.

(6) Modification Examples (6-1) Modification Example 1A

Figure 4:
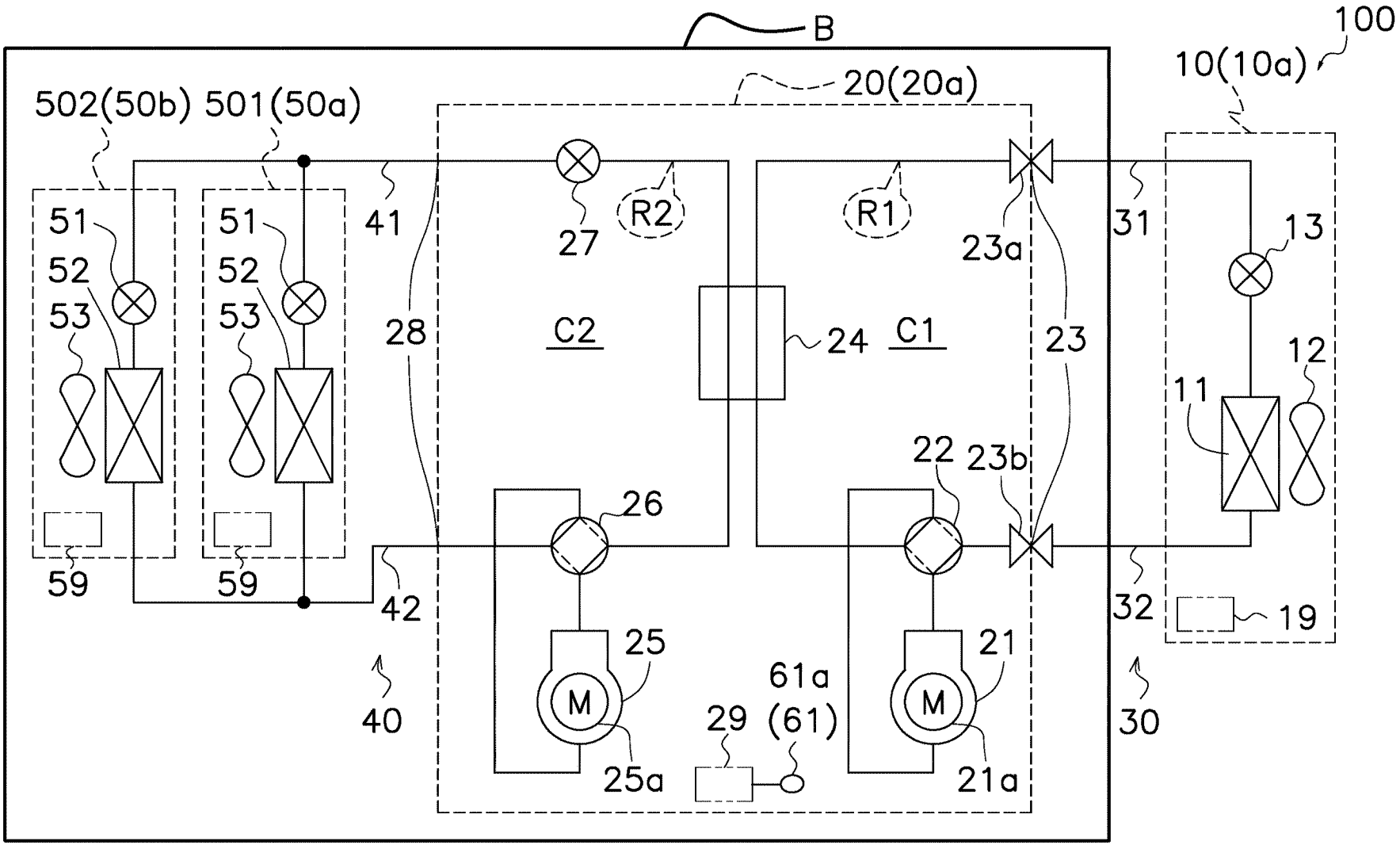
FIG. 4 is a circuit diagram of the refrigeration apparatus 100 according to a modification example 1A of the first embodiment.

FIG. 4 depicts the refrigeration apparatus 100 according to the modification example 1A of the first embodiment. Unlike the above embodiment, the refrigeration apparatus 100 includes neither the second liquid side shutoff valve 28*a* nor the second gas side shutoff valve 28*b* at the second connecting port 28.

Also in this configuration, the first liquid side shutoff valve 23*a* and the first gas side shutoff valve 23*b* are shut off upon detection of refrigerant leakage to inhibit refrigerant leakage.

The second refrigerant R2 used in the second refrigerant cycle C2 is preferably an incombustible refrigerant such as R410 in this configuration. Adopting such an incombustible refrigerant in the second refrigerant cycle C2 including the utilization units 501 and 502 secures safety of the user even in a case where the second refrigerant R2 leaks in the second refrigerant cycle C2.

Furthermore, adopting R32 or carbon dioxide as the first refrigerant R1 used in the first refrigerant cycle C1 inhibits global warming caused by the refrigeration apparatus 100.

(6-2) Modification Example 1B

Figure 5:
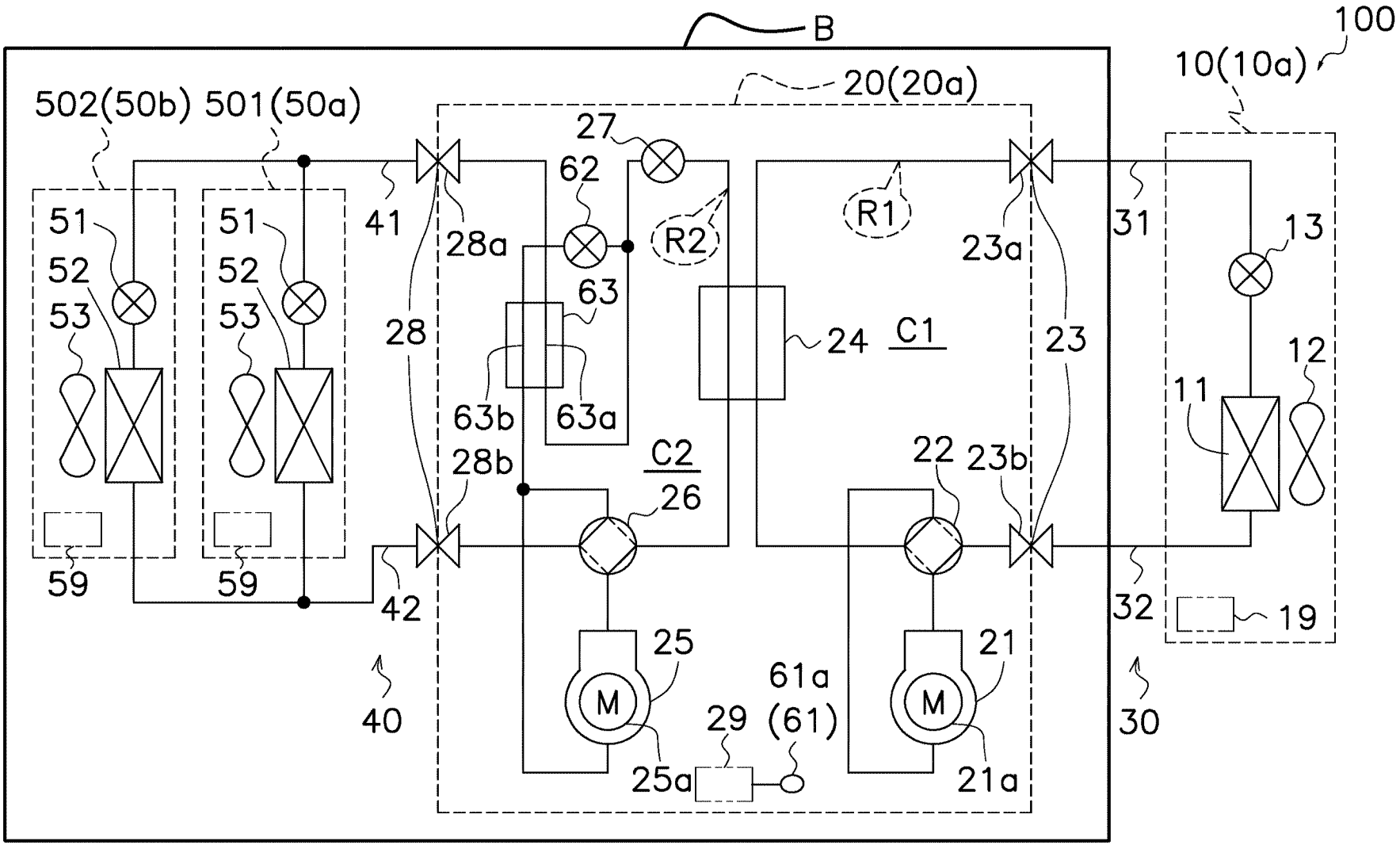
FIG. 5 is a circuit diagram of the refrigeration apparatus 100 according to a modification example 1B of the first embodiment.

FIG. 5 depicts the refrigeration apparatus 100 according to the modification example 1B of the first embodiment. Unlike the above embodiment, the compressor unit 20 includes a decompression valve 62 and a subcooling heat exchanger 63. The decompression valve 62 and the subcooling heat exchanger 63 belong to the second refrigerant cycle C2. The subcooling heat exchanger 63 includes a first refrigerant flow path 63*a* and a second refrigerant flow path 63*b*.

The decompression valve 62 decompresses the second refrigerant R2 to obtain the second refrigerant R2 in a low-temperature gas state. The second refrigerant R2 in the low-temperature gas state passes through the second refrigerant flow path 63*b*. The second refrigerant R2 passing through the first refrigerant flow path 63*a* is cooled by the second refrigerant R2 passing through the second refrigerant flow path 63*b* to acquire a degree of subcooling. The second refrigerant R2 flowing out of the second refrigerant flow path 63*b* is sucked into a suction pipe of the second compressor 25.

The second refrigerant cycle C2 in this configuration includes the subcooling heat exchanger 63. This configuration is thus likely to secure subcooling in the utilization units 501 and 502.

Furthermore, the second refrigerant R2 in this configuration partially passes through the second refrigerant flow path 63*b* serving as a bypass route. Even in a case where the second connection piping 40 (the second liquid connection pipe 41 and the second gas connection pipe 42) in the second refrigerant cycle C2 has a large length, the second refrigerant R2 flowing in the second connection piping 40 is reduced in volume to achieve reduction in pressure loss of the second refrigerant R2 as well as secure subcooling.

The second refrigerant R2 flowing out of the second refrigerant flow path 63*b* may alternatively be intermediately injected, i.e., be injected directly to a compression chamber of the second compressor 25, instead of being sucked into the suction pipe of the second compressor 25.

(6-3) Modification Example 1C

Figure 6:
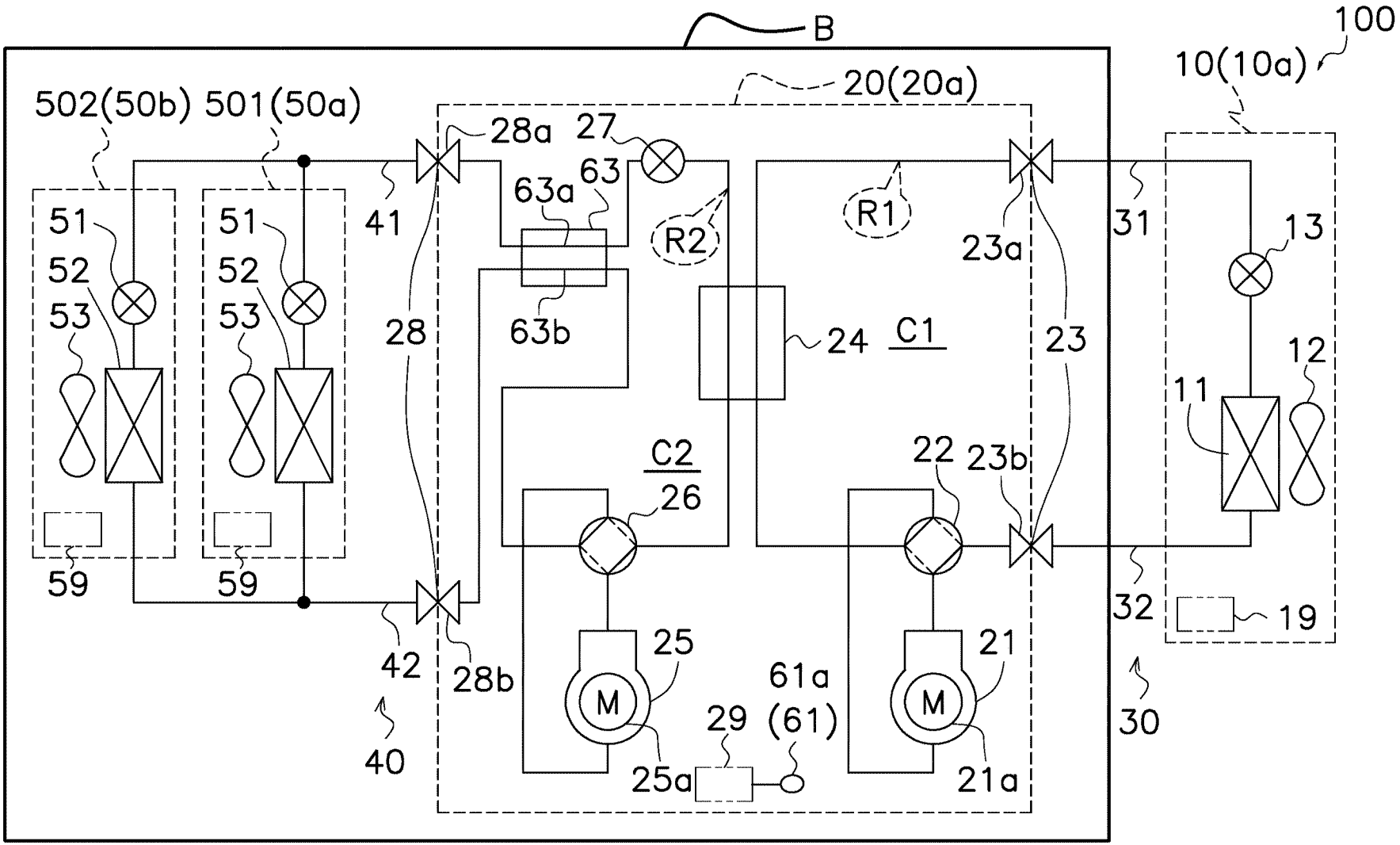
FIG. 6 is a circuit diagram of the refrigeration apparatus 100 according to a modification example 1C of the first embodiment.

FIG. 6 depicts the refrigeration apparatus 100 according to the modification example 1C of the first embodiment. Unlike the above embodiment, the compressor unit 20 includes the subcooling heat exchanger 63. The subcooling heat exchanger 63 belongs to the second refrigerant cycle C2. The subcooling heat exchanger 63 includes a first refrigerant flow path 63*a* and a second refrigerant flow path 63*b*.

The second refrigerant cycle C2 in this configuration includes the subcooling heat exchanger 63. This configuration is thus likely to secure subcooling in the utilization units 501 and 502.

This secures the degree of subcooling even in a case where the second refrigerant R2 has less circulation volume. In this case, the second refrigerant R2 flowing in the second connection piping 40 (the second liquid connection pipe 41 and the second gas connection pipe 42) can be reduced in pressure loss while the compressor 25 can be reduced in electric power consumption.

(6-4) Modification Example 1D

Figure 7:
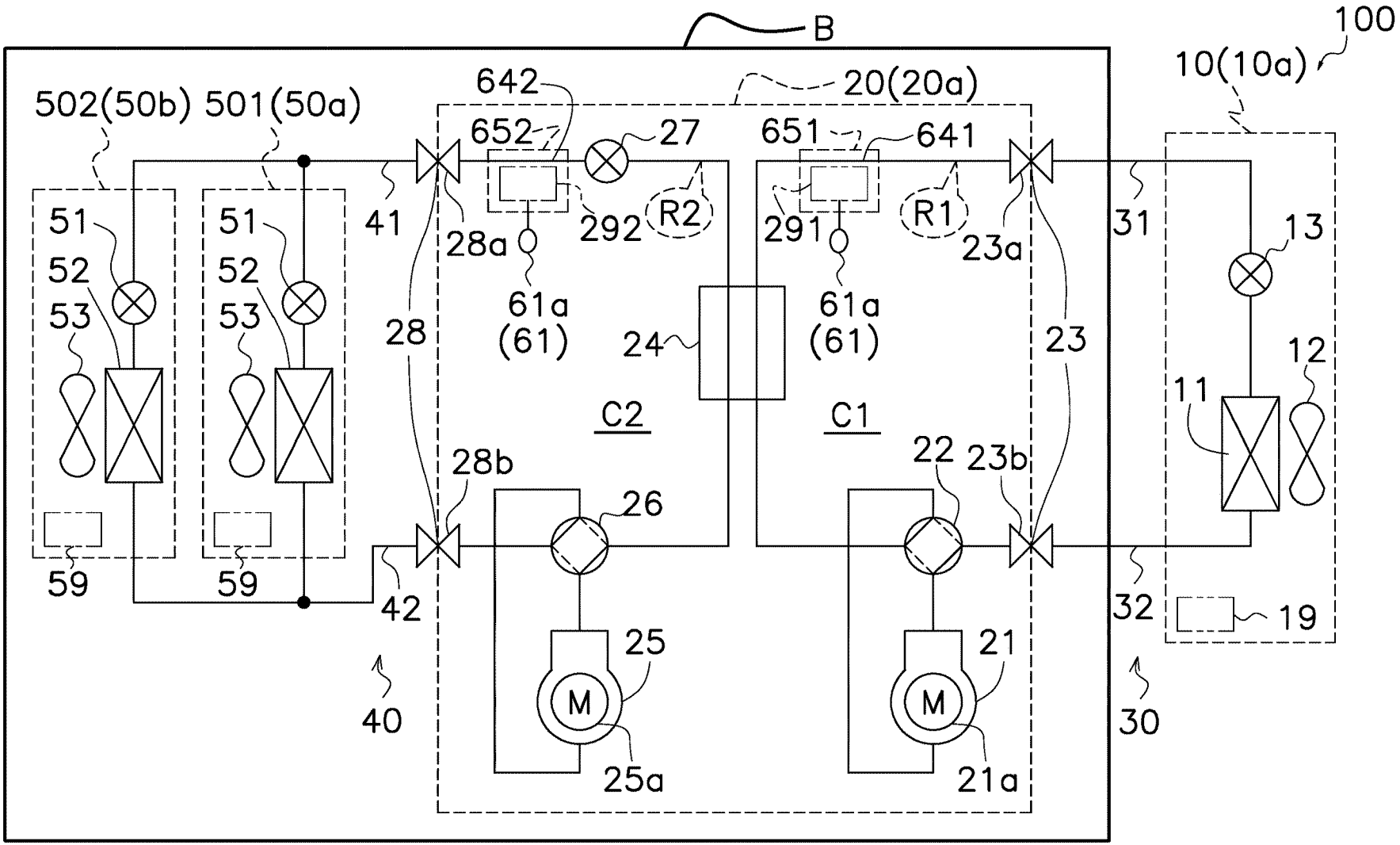
FIG. 7 is a circuit diagram of the refrigeration apparatus 100 according to a modification example 1D of the first embodiment.

FIG. 7 depicts the refrigeration apparatus 100 according to the modification example 1D of the first embodiment. Unlike the above embodiment, the compressor unit 20 includes refrigerant jackets 651 and 652. The refrigerant jackets 651 and 652 thermally couple circuit boards constituting compressor unit control units 291 and 292, and cooling pipes 641 and 642, respectively. The cooling pipes 641 and 642 each guide a liquid refrigerant. The circuit boards constituting the compressor unit control units 291 and 292 are thus cooled by the cooling pipes 641 and 642, respectively.

In this configuration, the compressor unit control units 291 and 292 are cooled by the cooling pipes 641 and 642, respectively. This achieves effective cooling of the compressor unit control units 291 and 292 that generate heat.

(6-5) Modification Example 1E

Figure 8:
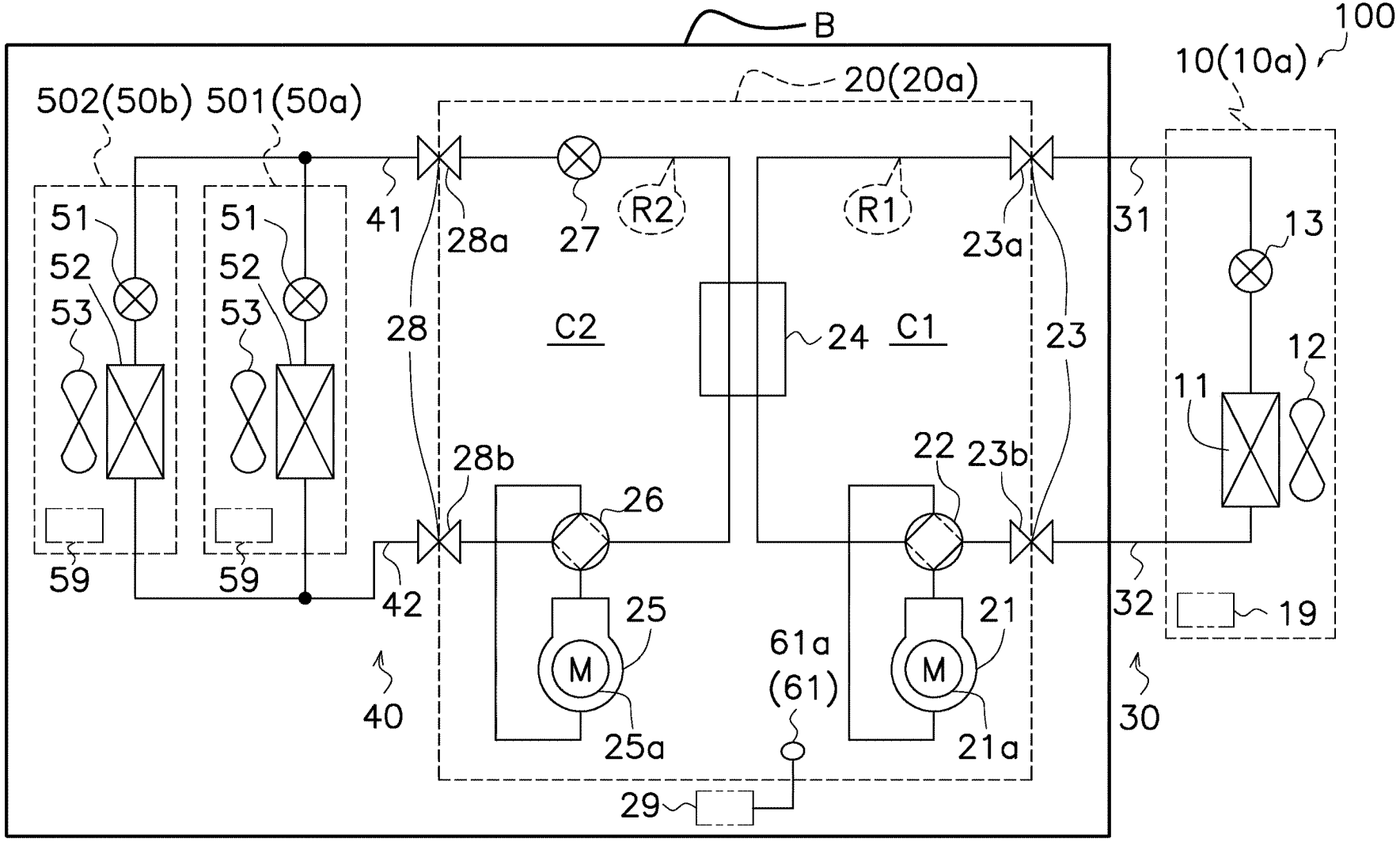
FIG. 8 is a circuit diagram of the refrigeration apparatus 100 according to a modification example 1E of the first embodiment.

FIG. 8 depicts the refrigeration apparatus 100 according to the modification example 1E of the first embodiment. In this refrigeration apparatus 100, unlike the above embodiment, the circuit board constituting the compressor unit control unit 29 is disposed outside the case 20*a*. This enables effective release of heat generated by the compressor unit control unit 29.

(6-6) Modification Example 1F

Figure 9:
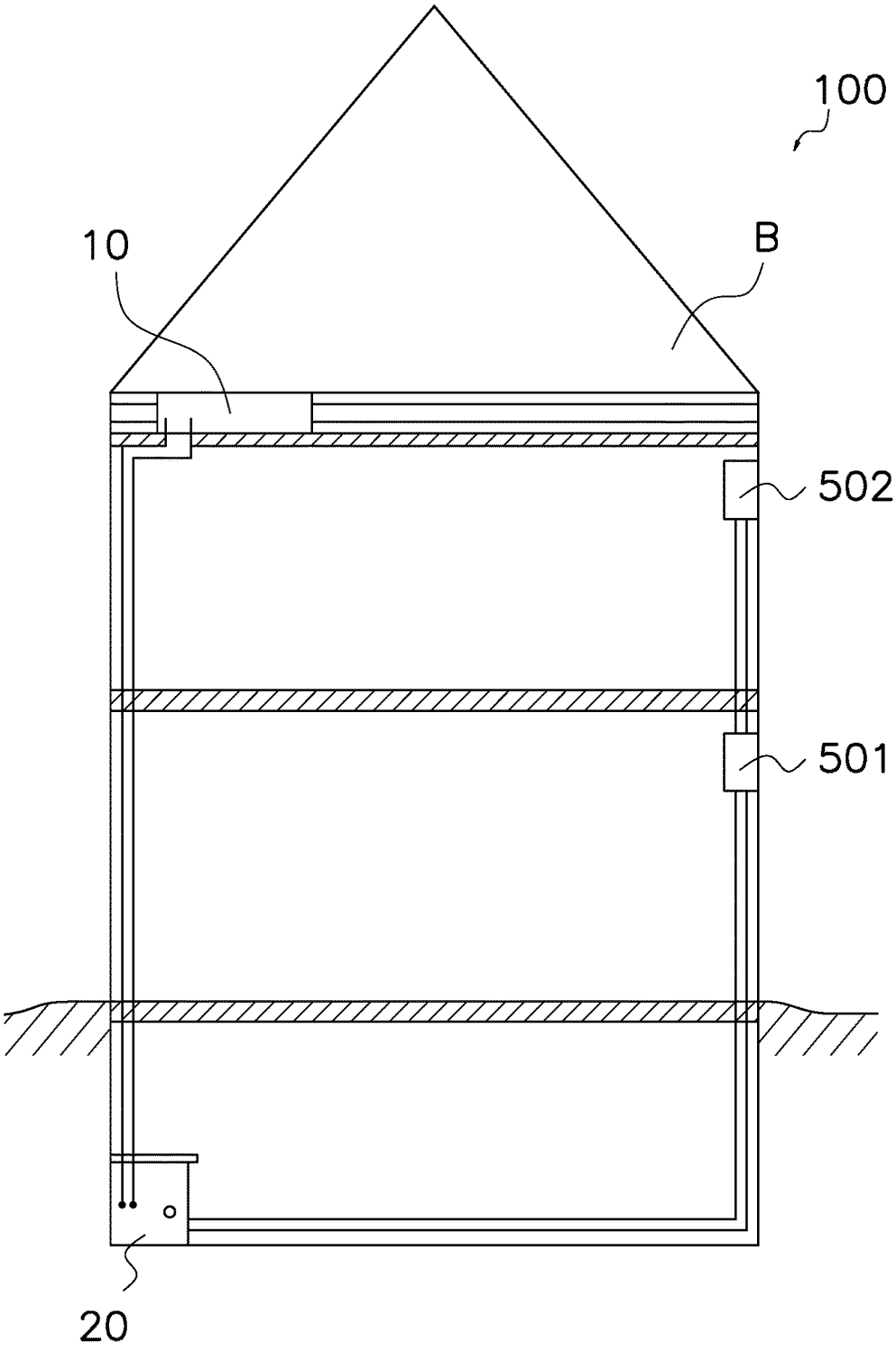
FIG. 9 is a schematic view of the refrigeration apparatus 100 according to a modification example 1F of the first embodiment.

The heat source heat exchanger unit 10 according to the above embodiment is disposed outside the building B. The heat source heat exchanger unit 10 may alternatively be disposed inside the building B and be fluid connected to an outside of the building B. As exemplarily depicted in FIG. 9, the heat source heat exchanger unit 10 may be disposed at a duct provided to the building B and allowing passage of outdoor air.

The heat source heat exchanger unit 10 in this configuration is invisible from outside the building B. The refrigeration apparatus 100 thus does not affect quality in outer appearance of the building B.

(6-7) Modification Example 1G

The above embodiment employs two utilization units, namely, the utilization units 501 and 502. The number of the utilization units may alternatively be other than two. For example, the number of the utilization units may be one, three, or four.

(6-8) Modification Example 1H

The heat source heat exchanger 11 mounted to the heat source heat exchanger unit 10 according to the above embodiment is configured to exchange heat between the first refrigerant R1 and air. The heat source heat exchanger 11 may alternatively be configured to exchange heat between the first refrigerant R1 and water. The heat source heat exchanger 11 may still alternatively be configured to exchange heat between the first refrigerant R1 and brine. In this case, the heat source heat exchanger 11 is connected to the first refrigerant cycle C1 as well as to a cooling tower or the like.

(6-9) Modification Example 1I

The utilization heat exchanger 52 mounted to each of the utilization units 501 and 502 according to the above embodiment is configured to exchange heat between the second refrigerant R2 and air. The utilization heat exchanger 52 may alternatively be configured to exchange heat between the second refrigerant R2 and water. This configuration achieves provision of hot water to the user. The utilization heat exchanger 52 may still alternatively be configured to exchange heat between the second refrigerant R2 and brine. In this case, the utilization heat exchanger 52 is connected to the second refrigerant cycle C2 as well as to a heat radiator or the like. The heat radiator provides the user with heat energy carried by the brine.

Second Embodiment (1) Configuration

Figure 10:
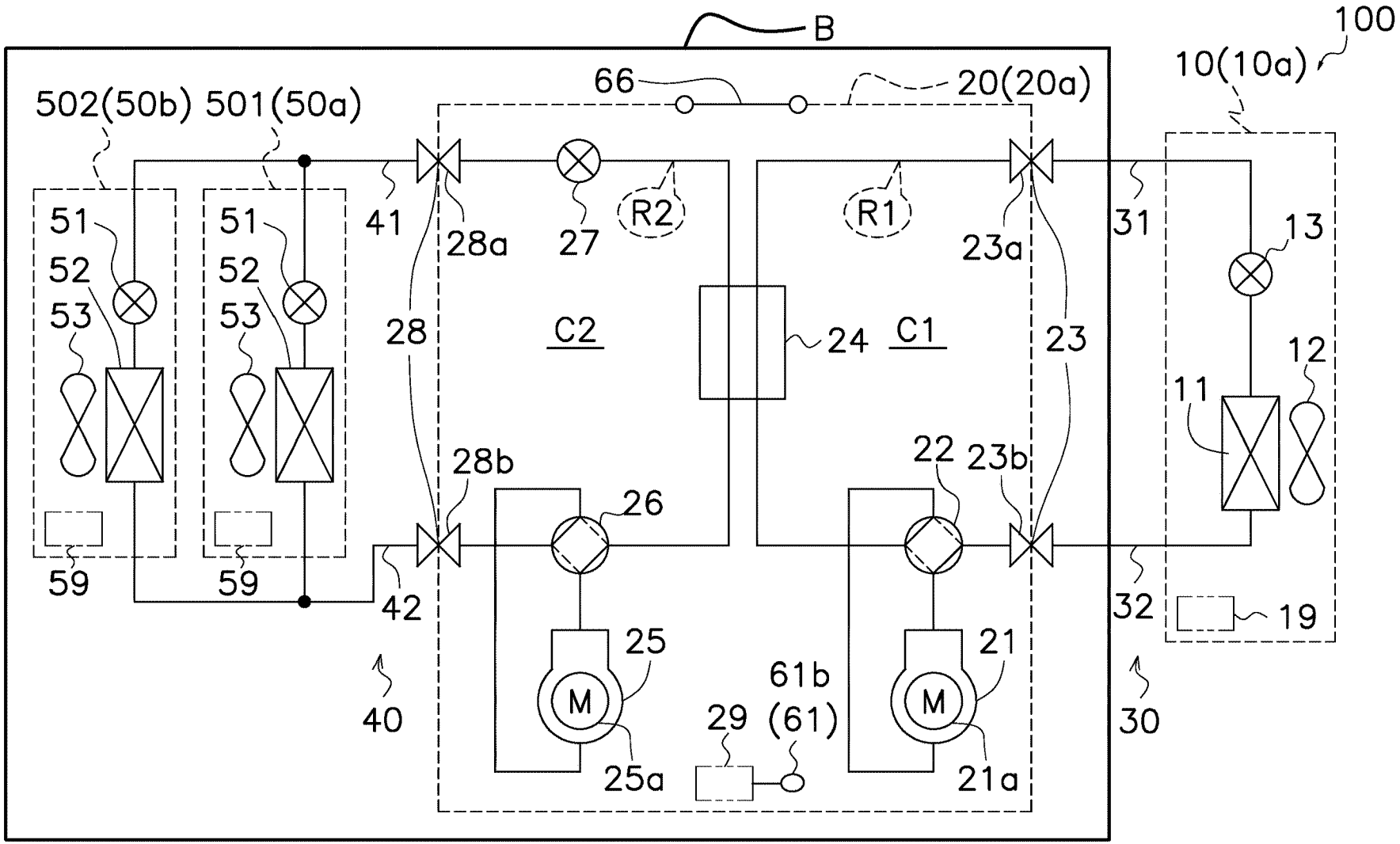
FIG. 10 is a circuit diagram of a refrigeration apparatus 100 according to a second embodiment.

FIG. 10 is a circuit diagram of a refrigeration apparatus 100 according to the second embodiment. In this refrigeration apparatus 100, unlike the first embodiment, the leakage detection sensor 61 is a pressure sensor 61*b*. The pressure sensor 61*b* detects pressure in the case 20*a*. The case 20*a* has airtightness. The case 20*a* further includes a rupture disk 66. The rupture disk 66 is destroyed by pressure exceeding a predetermined value.

(2) Characteristics (2-1)

The case 20*a* has airtightness. This inhibits a refrigerant leaking in the case 20*a* from reaching outside the case 20*a*.

(2-2)

The leakage detection sensor 61 is the pressure sensor 61*b*. When a refrigerant leaks in the case 20*a* having airtightness, refrigerant leakage can be detected in accordance with pressure change.

(2-3)

The case 20*a* includes the rupture disk 66. The rupture disk 66 is thus destroyed to release abnormally increased pressure in the case 20*a*.

(2-4)

The case 20*a* has airtightness. The compressor unit 20 thus has higher sound insulation. This is particularly useful when the compressor unit 20 is disposed inside the building B.

(2-5)

The case 20*a* has airtightness. The case 20*a* thus achieves a higher electromagnetic noise cutoff effect when the case 20*a* is made of a metal.

(3) Modification Examples (3-1) Modification Example 2A

The above embodiment does not refer to cooling of the circuit board constituting the compressor unit control unit 29. The case 20*a* of the compressor unit 20 has airtightness, so that the case 20*a* is likely to contain heat generated by the circuit board. As in the modification example 1D, there may be provided the refrigerant jacket thermally connecting the circuit board and the cooling pipe.

The circuit board in this configuration is cooled to inhibit containment of heat in the case 20*a*.

(3-2) Modification Example 2B

The circuit board constituting the compressor unit control unit 29 according to the above embodiment is disposed inside the case 20*a*. The case 20*a* of the compressor unit 20 has airtightness, so that the case 20*a* is likely to contain heat generated by the circuit board. As in the modification example 1E, the circuit board may alternatively be disposed outside the case 20*a*.

This configuration can inhibit containment of heat in the case 20*a*.

(3-3) Modification Example 2C

Any one of the modification examples of the first embodiment may be applied to the second embodiment.

CLOSING

The embodiments of the present disclosure have been described above. Various modifications to modes and details should be available without departing from the object and the scope of the present disclosure recited in the claims.

REFERENCE SIGNS LIST

10: heat source heat exchanger unit
10*a*: case (second case)
11: heat source heat exchanger
13: heat source heat exchanger unit expansion valve (first main expansion valve)
20: compressor unit
20*a*: case (first case)
21: first compressor
23: first connecting port
23*a*: first liquid side shutoff valve (first shutoff valve)
23*b*: first gas side shutoff valve (first shutoff valve)
24: cascade heat exchanger
25: second compressor
27: compressor unit expansion valve (second main expansion valve)
28: second connecting port
28*a*: second liquid side shutoff valve
28*b*: second gas side shutoff valve
29: compressor unit control unit (control unit)
30: first connection piping
40: second connection piping
50*a*: case (third case)
50*b*: case
51: utilization unit expansion valve
52: utilization heat exchanger
61: leakage detection sensor
61*a*: refrigerant detection sensor
61*b*: pressure sensor
63: subcooling heat exchanger
66: rupture disk
100: refrigeration apparatus
501: utilization unit
502: utilization unit
641: cooling pipe (cooling refrigerant pipe)
642: cooling pipe (cooling refrigerant pipe)
B: building
C1: first refrigerant cycle
C2: second refrigerant cycle
R1: first refrigerant
R2: second refrigerant

CITATION LIST

Patent Literature

Patent Literature 1: Japanese Patent Application Laid-Open Publication No. 2018-511771

The invention claimed is:

1. A refrigeration apparatus comprising:

a compressor unit comprising:
- a first case;
- a first compressor accommodated in the first case;
- a cascade heat exchanger accommodated in the first case;
- a second compressor accommodated in the first case;
- a first connecting port;
- a second connecting port;
- a leakage detection sensor accommodated in the first case and configured to detect leakage of at least one of the first refrigerant or the second refrigerant;
- a first liquid side shutoff valve configured to shutoff shift of the first refrigerant between the cascade heat exchanger and a heat source heat exchanger; and
- a first gas side shutoff valve configured to shut off shift of the first refrigerant between the first compressor and the heat source hear exchanger;
- a second liquid side shutoff valve configured to shut off shift of the second refrigerant between the cascade heat exchanger and a utilization heat exchanger;
- a second gas side shutoff valve configure to shut off shift of the second refrigerant between the second compressor and the utilization heat exchanger; and
- a controller configured to close the first liquid side shutoff valve, first gas side shutoff valve, second liquid side shutoff valve, and second gas side shutoff valve when the leakage detection sensor detects leakage, a heat source heat exchanger unit including a second case and the heat source heat exchanger; and a utilization unit including a third case and the utilization heat exchanger, wherein the first compressor, the cascade heat exchanger, the first liquid side shutoff valve, the first gas side shutoff valve, and the heat source heat exchanger constitute a first refrigerant cycle adopting the heat source heat exchanger as a heat source and configured to cause circulation of the first refrigerant, the heat source heat exchanger accommodated in the second case provided separately from the first case, the second compressor, the cascade heat exchanger, the second liquid side shutoff valve, the second gas side shutoff valve, and the utilization heat exchanger constitute a second refrigerant cycle adopting the cascade heat exchanger as a heat source and configured to cause circulation of a second refrigerant, the utilization heat exchanger accommodated in the third case provided separately from the first case, the cascade heat exchanger exchanges heat between the first refrigerant and the second refrigerant, the first connecting port is connected to the heat source heat exchanger via a first connection piping, the second connecting port is connected to the utilization heat exchanger via a second connection piping.

2. The refrigeration apparatus according to claim 1, the compressor unit further comprising a subcooling heat exchanger accommodated in the first case, wherein the subcooling heat exchanger belongs to the second refrigerant cycle.

3. The refrigeration apparatus according to claim 1, wherein the controller is disposed outside the first case.

4. The refrigeration apparatus according to claim 1, the compressor unit further comprising a cooling refrigerant pipe accommodated in the first case, wherein the controller is disposed inside the first case and is cooled by the cooling refrigerant pipe.

5. The refrigeration apparatus according to claim 1, wherein the first case has airtightness.

6. The refrigeration apparatus according to claim 5, wherein the leakage detection sensor is a pressure sensor configured to detect pressure in the first case.

7. The refrigeration apparatus according to claim 5, wherein the first case includes a rupture disk destroyed by pressure exceeding a predetermined value.

8. The refrigeration apparatus according to claim 1, wherein the first refrigerant is R32 or carbon dioxide.

9. The refrigeration apparatus according to claim 1, wherein the compressor unit is disposed inside a building, and the heat source heat exchanger unit is disposed inside the building and is fluid connected to an outside of the building.

10. The refrigeration apparatus according to claim 1, wherein the heat source heat exchanger unit includes a first main expansion valve belonging to the first refrigerant cycle and accommodated in the second case, and the compressor unit includes a second main expansion valve belonging to the second refrigerant cycle and accommodated in the first case.

11. The refrigeration apparatus according to claim 3, wherein the leakage detection sensor is a refrigerant detection sensor configured to detect presence of at least one of the first refrigerant or the second refrigerant.

12. The refrigeration apparatus according to claim 4, wherein the leakage detection sensor is a refrigerant detection sensor configured to detect presence of at least one of the first refrigerant or the second refrigerant.

* * * * *